US010514632B2

(12) United States Patent
Perez et al.

(10) Patent No.: US 10,514,632 B2
(45) Date of Patent: Dec. 24, 2019

(54) METHOD OF REMANUFACTURING A TONER CARTRIDGE

(71) Applicant: CLOVER TECHNOLOGIES GROUP, LLC, Hoffman Estates, IL (US)

(72) Inventors: Jesus Gonzalez Perez, Chatsworth, CA (US); Oswaldo Cota, North Hills, CA (US)

(73) Assignee: Clover Technologies Group, LLC, Ottawa, IL (US)

( * ) Notice: Subject to any disclaimer, the term of this patent is extended or adjusted under 35 U.S.C. 154(b) by 29 days.

(21) Appl. No.: 15/597,916

(22) Filed: May 17, 2017

(65) Prior Publication Data

US 2017/0336736 A1 Nov. 23, 2017

Related U.S. Application Data

(60) Provisional application No. 62/338,286, filed on May 18, 2016.

(51) Int. Cl.
*G03G 15/08* (2006.01)

(52) U.S. Cl.
CPC ..... *G03G 15/0894* (2013.01); *G03G 15/0865* (2013.01); *G03G 15/0881* (2013.01)

(58) Field of Classification Search
CPC ..... G03G 15/0865; G03G 15/0881; G03G 15/0894
See application file for complete search history.

(56) References Cited

U.S. PATENT DOCUMENTS 4,862,210 A * 8/1989 Woolley ..... G03G 15/0894 399/106
4,895,104 A * 1/1990 Yoshino ..... G03G 15/0882 222/DIG. 1
4,930,684 A * 6/1990 Patterson ..... G03G 15/0894 222/325
5,404,212 A 4/1995 Ditomaso
5,729,795 A * 3/1998 Kavolius ..... G03G 15/0894 399/109

(Continued)

FOREIGN PATENT DOCUMENTS

EP 1132783 A2 9/2001
EP 1152300 A2 11/2001

(Continued)

OTHER PUBLICATIONS

International Search Report and Written Opinion, International Application No. PCT/2017/033127, dated Jul. 31, 2017, 12 pages, European PatentOffice, HV Rijswijk, NL-2280.

(Continued)

*Primary Examiner* — David J Bolduc
(74) *Attorney, Agent, or Firm* — Michael Best & Friedrich LLP

(57) ABSTRACT

A method of remanufacturing a toner cartridge includes installing a modified end cap in which a portion of a drive assembly for an internal toner seal removal mechanism has been disabled. With the modified end cap installed, the toner cartridge may be post tested without removing the internal toner seal. When the post test is complete the modified end cap is removed and a non-modified end cap with a functional drive assembly is installed in its place.

6 Claims, 6 Drawing Sheets

(56) References Cited

U.S. PATENT DOCUMENTS 6,029,031 A * 2/2000 Yokomori ..... G03G 15/0894 399/109
7,693,448 B1 4/2010 Lenahan
9,146,503 B2 9/2015 Shindo
9,164,430 B2 10/2015 Murakami et al.
2001/0041080 A1* 11/2001 Higeta ..... G03G 15/0894 399/103
2002/0012546 A1* 1/2002 Chanadi ..... G03G 21/1647 399/106
2002/0025183 A1* 2/2002 Murakami ..... G03G 15/0894 399/109
2002/0054771 A1* 5/2002 Higeta ..... G03G 21/181 399/109
2002/0088138 A1* 7/2002 Murakami ..... F26B 5/12 34/437
2003/0170045 A1 9/2003 Lewis et al.
2005/0028492 A1* 2/2005 Nagashima ..... B29C 65/08 53/471
2005/0281580 A1* 12/2005 Lewis ..... G03G 15/0894 399/109
2006/0133847 A1* 6/2006 Burton ..... G03G 15/0894 399/106
2008/0247775 A1* 10/2008 Rummler ..... G03G 15/0894 399/109
2009/0245853 A1* 10/2009 Lewis ..... G03G 15/0894 399/106
2011/0293322 A1* 12/2011 Shanun ..... G03G 15/0894 399/109
2014/0265159 A1* 9/2014 Shanun ..... G03G 15/0882 277/630
2015/0323887 A1* 11/2015 Tuvesson ..... G03G 15/0808 399/109
2016/0116861 A1* 4/2016 Yamaguchi ..... G03G 15/0868 399/109
2016/0116864 A1* 4/2016 Kase ..... G03G 15/0874 399/109
2016/0124347 A1* 5/2016 Isobe ..... G03G 15/0874 399/109
2016/0306298 A1* 10/2016 Daniels ..... G03G 15/0884
2016/0306299 A1* 10/2016 Daniels ..... G03G 15/0894
2017/0123372 A1* 5/2017 Yamaguchi ..... G03G 15/0868
2017/0235274 A1* 8/2017 Daniels ..... G03G 15/0884 399/109
2017/0329256 A1 11/2017 Li et al.

FOREIGN PATENT DOCUMENTS

EP 2945021 A1 11/2015
WO 2017/196846 A1 11/2017
WO 2017/201174 A1 11/2017

OTHER PUBLICATIONS

Static Control Remanufacturing Instructions for Brother HL-5250/5350 Toner Cartridge and Drum Unit, Jul. 26, 2013, XP055392369, Retrieved from the Internet: URL: http://www.wbt-berlin.de/anl/Anl_KY/tk, 1110 Reman-ChipInstCombo.pdf, 17 pages.
International Search Report and Written Opinion, International Application No. PCT/US2017/031757, dated Aug. 14, 2017, 10 pages, European Patent Office, HV Rijswijk, NL-2280.
Non-Final Office Action for U.S. Appl. No. 15/590,498, dated Aug. 30, 2018, 21 pages.
International Preliminary Report on Patentability for PCT Application No. PCT/US2017/031757, dated Nov. 22, 2018, 8 pages.
International Preliminary Report on Patentability for PCT Application No. PCT/US2017/033127, dated Nov. 29, 2018, 8 pages.

* cited by examiner

METHOD OF REMANUFACTURING A TONER CARTRIDGE

CROSS-REFERENCE TO RELATED APPLICATION

This application claims the benefit of and priority to U.S. Provisional Patent Application No. 62/338,286, filed May 18, 2016, the entire contents of which are hereby incorporated by reference herein.

BACKGROUND

The present disclosure relates to consumable cartridges used in image forming apparatuses, and more specifically to a remanufactured cartridge that has been modified to permit testing of the cartridge after the remanufacturing without disturbing a toner seal configuration that reduces leakage of toner from the cartridge during shipping.

Imaging cartridges, and particularly toner cartridges, are frequently provided with toner seals that cover a toner opening provided in the toner hopper through which toner is dispensed during operation of the cartridge. These seals are removable just prior to the toner cartridge being used for a printing operation either manually by a user or by a mechanism included in the toner cartridge or the image forming apparatus into which it is installed. The primary function of the seal is to prevent toner from leaking out of the toner opening of the cartridge during transportation and shipping of the toner cartridge.

Toner cartridge remanufacturers often perform a post test of the remanufactured cartridges after the cartridges have gone through the remanufacturing process but before they are packaged for sale to the end user. The post test is intended to reveal any issues that may have arisen during the remanufacturing process. If the post test reveals a printing defect the cartridge can be removed from the production line and the issue investigated. Although the specific technique may vary depending on the configuration of a specific cartridge, to conduct a post test remanufacturers will often insert a relatively small test charge of toner into the space between the developer roller and the "clean" side of the toner seal. In a typical post test the toner seal remains intact and print tests are conducted using the test charge of toner which makes its way through the cartridge in the same manner as toner from the hopper would if the toner seal was not present. When the post test is complete, remaining test charge toner may be vacuumed or blown from the cartridge before packaging.

Toner cartridges such as those disclosed in U.S. Pat. No. 9,164,430 (the '430 patent, the entire contents of which are hereby incorporated by reference herein) include a rotatable member within the toner hopper that removes an internal toner seal. Before the cartridge is inserted into a printer, the internal toner seal prevents toner from leaking out of a toner accommodating area. When the cartridge is inserted into the printer, driving rotatable force from the printer is transmitted to the cartridge through a drive mechanism. The drive mechanism operates a gear assembly in the cartridge which in turn rotates the rotatable member. When the rotatable member rotates it pulls the internal toner seal away from the toner opening, thereby allowing toner to flow through the toner opening toward the developer roller. Because the internal toner seal is automatically removed when the cartridge is inserted into the printer, post testing a cartridge that is remanufactured back to its original configuration would cause the internal toner seal to be removed, which may result in undesirable leaking of toner from the cartridge during packaging and shipment.

SUMMARY

In some aspects, a method of modifying a toner cartridge component to permit a post test of the toner cartridge without removing an internal toner seal is provided and includes uncovering a drive mechanism for driving a toner seal removal mechanism, disabling at least a portion of the drive mechanism, and recovering the drive mechanism while the at least a portion of the drive mechanism is disabled.

Disabling at least a portion of the drive mechanism may include removing at least one gear of the drive mechanism. Uncovering the drive mechanism may include removing a portion of the toner cartridge that at least partially covers the drive mechanism. Removing a portion of the toner cartridge may include removing at least the portion of the drive mechanism. Removing the portion of the toner cartridge may include removing a first end cap, and recovering the drive mechanism may include installing a second end cap. Recovering the drive mechanism may include reinstalling a portion of the toner cartridge that at least partially covers the drive mechanism. The method may also include separating a hopper section of the cartridge from a waste section of the cartridge before uncovering the drive mechanism. The method may also include reconnecting the hopper section of the cartridge to the waste section of the cartridge after recovering the drive mechanism.

In other aspects, a method of remanufacturing a toner cartridge is provided and includes obtaining a used toner cartridge configured for use with an internal toner seal that is automatically removed upon installation of the toner cartridge in a printer. The method also includes refilling a hopper section of the toner cartridge and installing the internal toner seal, uncovering a drive mechanism for operating a toner seal removal mechanism, disabling the drive mechanism to prevent operation of the toner seal removal mechanism, recovering the drive mechanism while the drive mechanism is disabled, installing the toner cartridge with the disabled drive mechanism into a printer to perform a post test, removing the toner cartridge from the printer after the post test, again uncovering the drive mechanism after removing the toner cartridge from the printer after the post test, and re-enabling the drive mechanism to permit operation of the toner seal removal mechanism.

Disabling the drive mechanism may include removing at least one gear from the drive mechanism. Uncovering the drive mechanism may include removing a portion of the toner cartridge. Removing the portion of the toner cartridge may include removing a portion of the drive mechanism. Uncovering the drive mechanism may include removing an end cap of the toner cartridge. Recovering the drive mechanism may include installing a portion of the toner cartridge. Re-enabling the drive mechanism may include replacing at least one gear of the drive mechanism.

In still other aspects, a method of remanufacturing a toner cartridge is provided and includes obtaining a used toner cartridge configured for use with an internal toner seal that is automatically removed upon installation of the toner cartridge in a printer, refilling a hopper section of the toner cartridge and installing the internal toner seal, removing an end cap of the toner cartridge, the end cap including a drive mechanism for operating a toner seal removal mechanism, creating a modified end cap to disable the drive mechanism, installing the modified end cap onto the toner cartridge, installing the toner cartridge with the modified end cap into a printer to perform a post test, removing the toner cartridge from the printer after the post test, removing the modified end cap, and installing a non-modified end cap with a functional drive mechanism to permit operation of the toner seal removal mechanism upon a subsequent insertion of the toner cartridge into a printer.

Creating the modified end cap may include removing at least one gear. Installing the non-modified end cap may include reinstalling the end cap that was previously removed.

In still other aspects, a method of remanufacturing a plurality of toner cartridges is provided and includes obtaining a plurality of used toner cartridges, each toner cartridge configured for use with an internal toner seal that is automatically removed upon installation of the toner cartridge in a printer, and each toner cartridge including an end cap including a drive mechanism for operating a toner seal removal mechanism, harvesting a plurality of the end caps from some of the plurality of used toner cartridges, modifying the harvested plurality of end caps to disable the drive mechanism in each end cap, installing one of the modified plurality of end caps on each of the plurality of used toner cartridges during a remanufacturing process, post testing the toner cartridges that have received one of the modified plurality of end caps, removing the modified end cap from each post tested toner cartridge, and installing a non-modified end cap with a functional drive mechanism on each post tested toner cartridge.

Modifying the harvested plurality of end caps may include removing at least one gear from the drive mechanism in each end cap. The method may also include reusing the removed modified end caps.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figure 1:
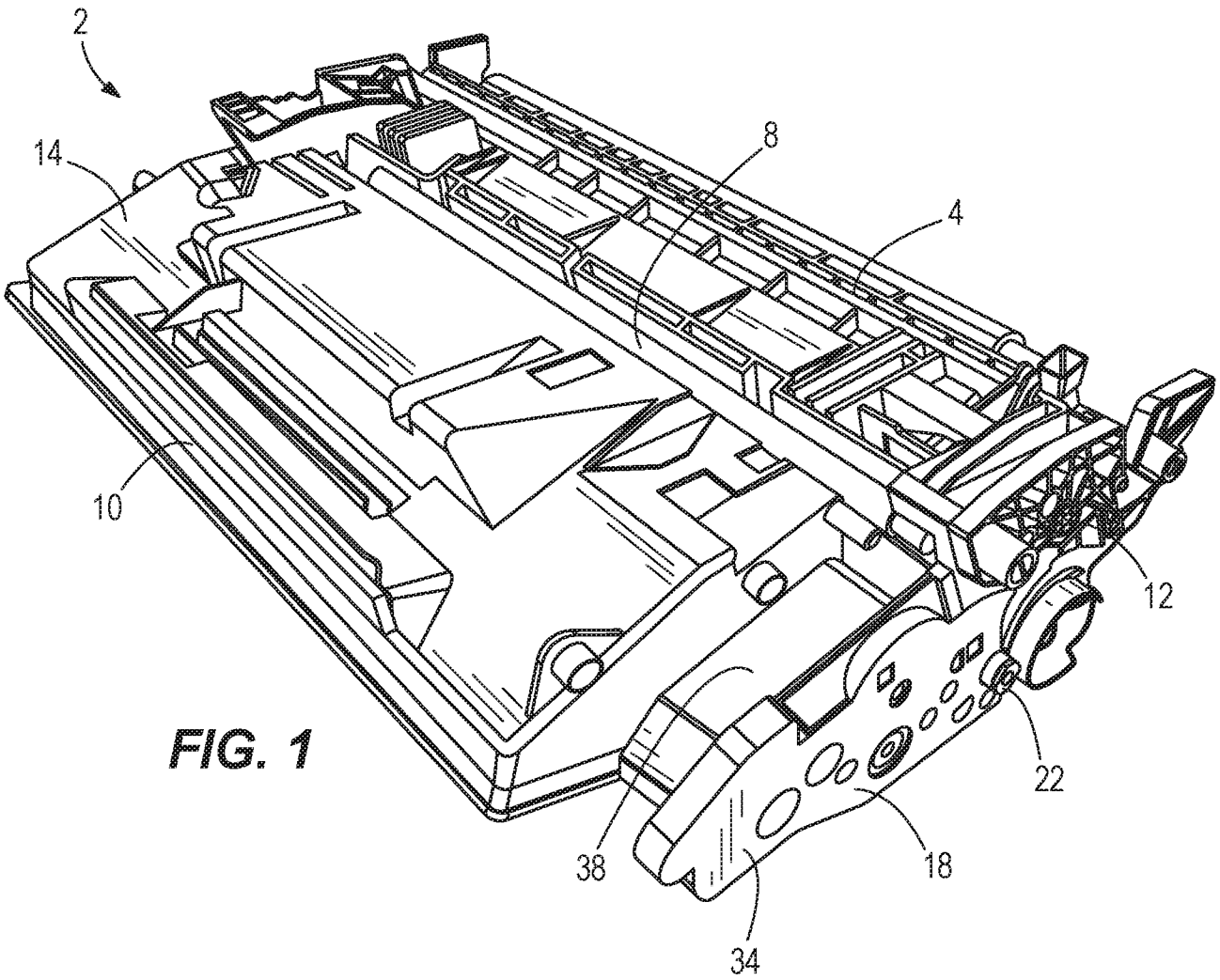
FIG. 1 is a perspective view of an exemplary toner cartridge that may be modified from its original configuration to permit the cartridge to be post tested after remanufacturing.

FIG. 1 illustrates a toner cartridge 2 upon which the remanufacturing methods described herein may be used. The illustrated toner cartridge is an HP CF287A type toner cartridge, but those skilled in the art will appreciate that the methods described herein may be used in connection with other types and brands of toner cartridges. The toner cartridge 2 includes a waste section 4 rotatably supporting an OPC drum 8. A hopper section 10, which holds toner for printing, is coupled to the waste section 4. In the illustrated cartridge 2 the waste section 4 and the hopper section 10 are pivotably coupled to one another by pins 12 (only one pin shown in FIG. 1), and can be separated from one another by removing the pins 12.

Figure 2:
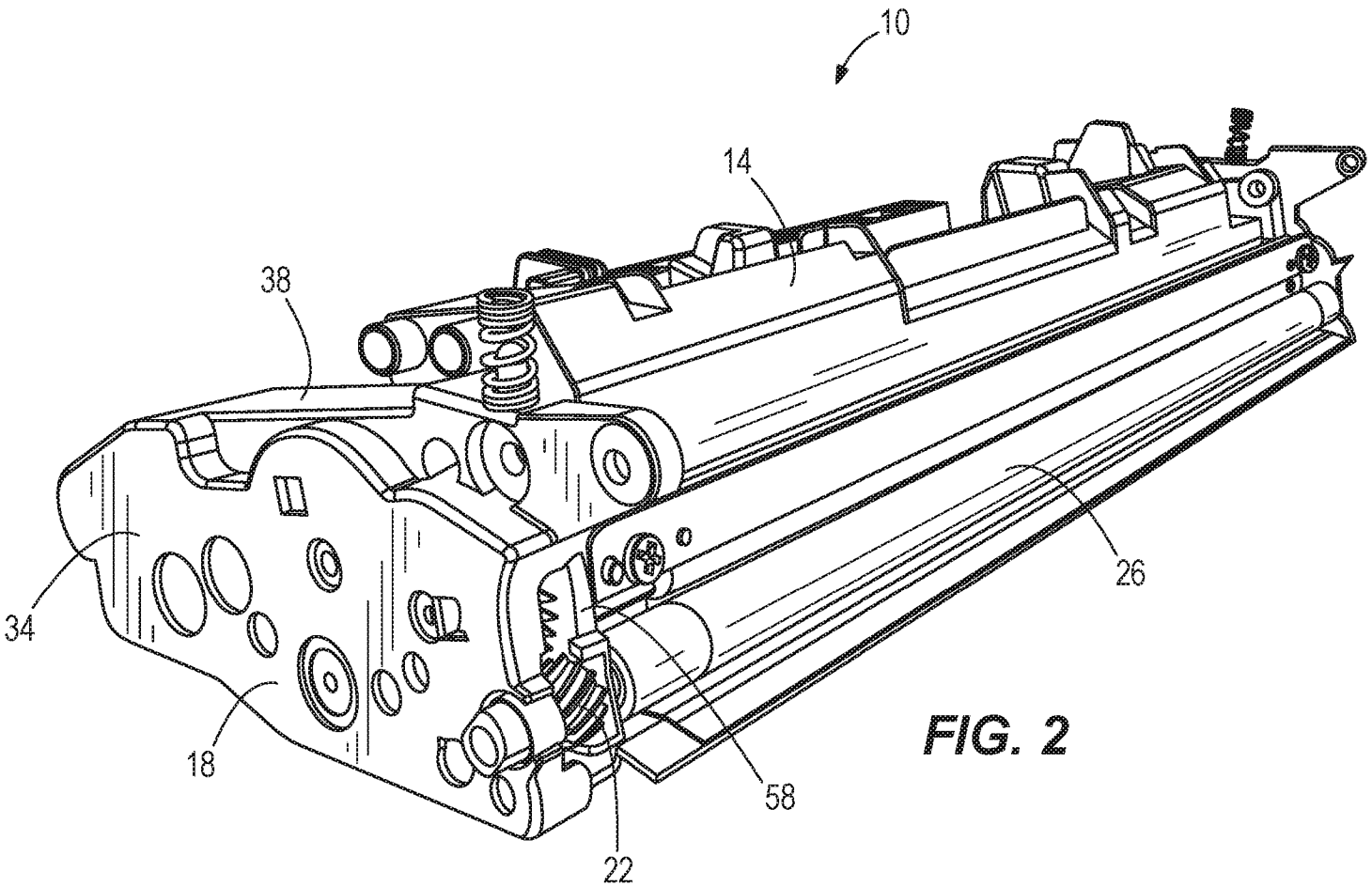
FIG. 2 is a perspective view of a hopper section of the toner cartridge of FIG. 1.

Referring also to FIG. 2, the hopper section 10 includes a main body 14 to which the other components are secured. For example, an end cap 18 is secured to one end of the main body 14 and rotatably supports a mag roller gear 22, which in turn rotatably supports one end of a mag roller 26. The mag roller 26, which may be referred to as a developer roller in other applications, rotates during printing operations and supplies toner to the OPC drum 8 in a known manner. Within the illustrated hopper section 10, there is a toner window located behind the mag roller 26 and therefore not visible in FIG. 2. As described, for example, in the '430 patent, the toner window defines a boundary between a toner storage chamber within the hopper section and a toner transfer chamber within the hopper section. Before the cartridge 2 is inserted into a printer a toner seal covers the toner window and prevents the movement of toner from the toner storage chamber to the toner transfer chamber to minimize leakage of toner from the cartridge 2 during packaging and shipment. When the cartridge 2 is inserted into a printer for the first time, a toner seal removal mechanism within the hopper section 10 operates to pull the seal away from the toner window, thereby allowing toner to move from the toner storage chamber to the toner transfer chamber where it can be transferred to the mag roller 26 and ultimately to the OPC drum 8 during a printing operation. In the exemplary toner cartridge 2, the toner seal removal mechanism includes an axle rotatably mounted within the hopper section 10 and extending substantially parallel to the mag roller 26. One end of the toner seal is coupled to the axle and the other end is coupled to the toner window such that when the axle rotates the toner seal is pulled away from the toner window. Once the toner seal is removed it functions as an agitator within the hopper section 10 to promote the movement of toner from the toner storage chamber to the toner transfer chamber.

When remanufacturing the toner cartridge 2, it may be desirable to provide the end user with a use experience that is as close to the original OEM configuration as possible. For this reason it may be desirable to install or reuse an internal seal that functions in the same way as the seal described above, e.g., an internal seal that is automatically removed upon insertion of the cartridge 2 into a printer. However, because it is also desirable to post test remanufactured cartridges, steps may be taken to prevent the internal seal from being removed during the post test to preserve the leak-reducing function of the internal seal.

Figure 3:
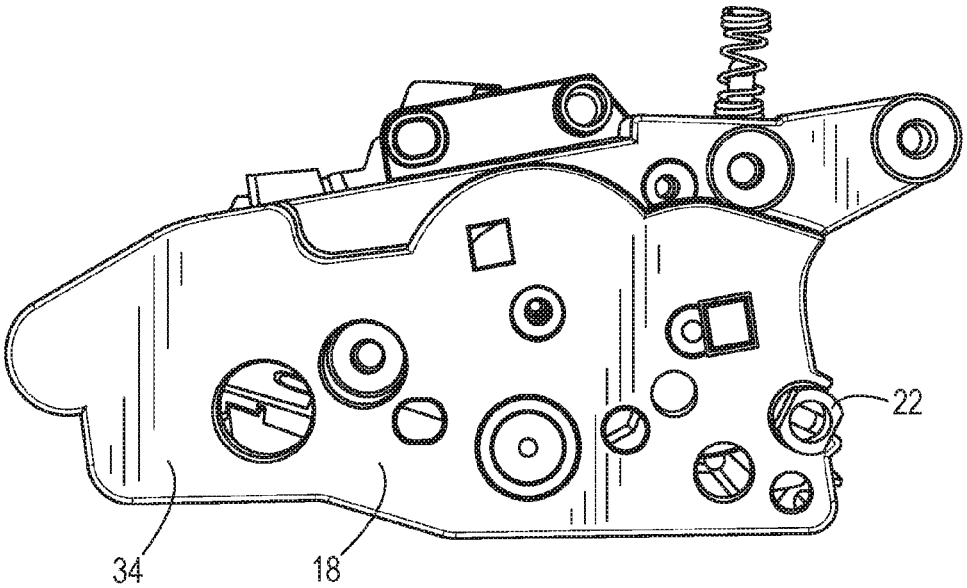
FIG. 3 is an end view of the hopper section of FIG. 2 showing an end cap of the hopper section.
Figure 4:
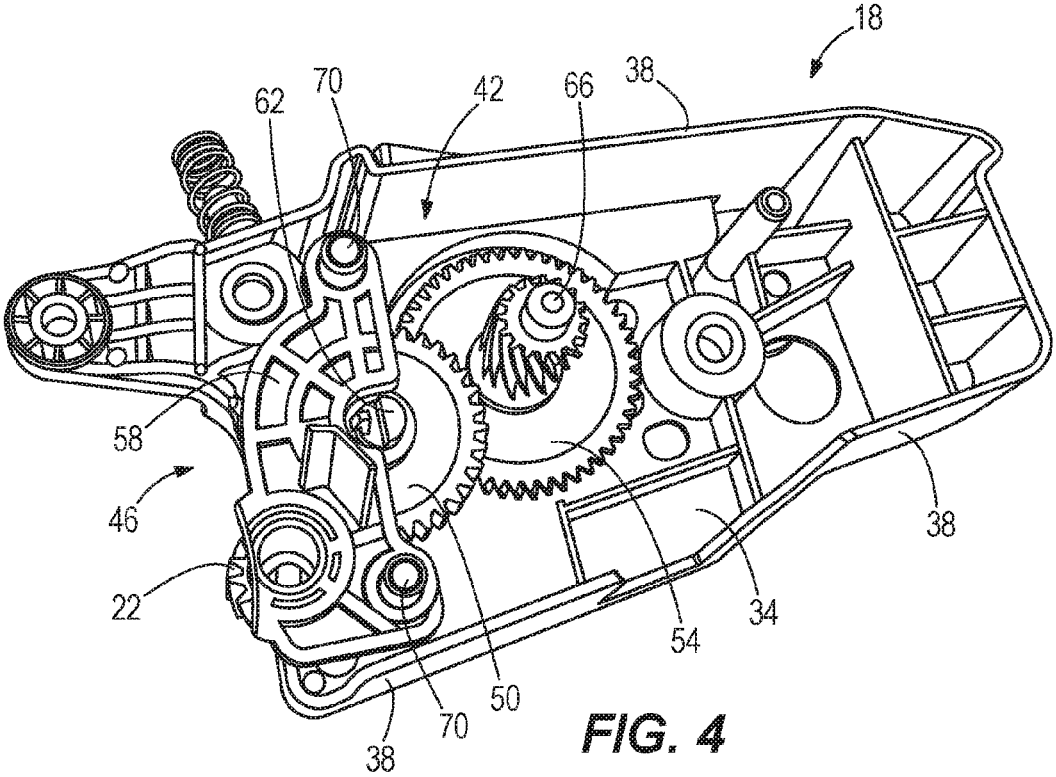
FIG. 4 is a perspective view of the interior of the end cap of FIG. 3 in an unmodified configuration.

Referring also to FIGS. 3-6, the end cap 18 of the cartridge 2 may be modified to prevent removal of the internal seal during a post test. FIGS. 3 and 4 illustrate the end cap 18 in an unmodified configuration. The end cap 18 includes an outer wall 34 and sidewalls 38. The outer wall 34 and sidewalls 38 cooperate to define a cavity 42 that houses a drive mechanism 46 for driving the toner seal removal mechanism. The illustrated drive mechanism 46 includes the mag roller gear 22, an intermediate gear 50 driven by the mag roller gear 22, and a drive gear 54 driven by the mag roller gear 22 via the intermediate gear (see FIG. 5) and operable to drive the toner seal removal mechanism within the hopper section 10. The drive mechanism 46 also includes a retainer 58 that partially supports the mag roller gear 22 and that overlies a portion of the intermediate gear 50 to retain and locate the intermediate gear 50 and the drive gear 54 within the cavity 42.

During normal operation driving rotatable force provided by the printer is transmitted to the mag roller 26. Rotation of the mag roller 26 causes rotation of the mag roller gear 22, which rotates the intermediate gear 50, which in turn rotates the drive gear 54. The drive gear 54 rotates a driven gear (not shown) associated with the toner seal removal mechanism. Rotation of the toner seal removal mechanism removes the toner seal, as described above.

Figure 5:
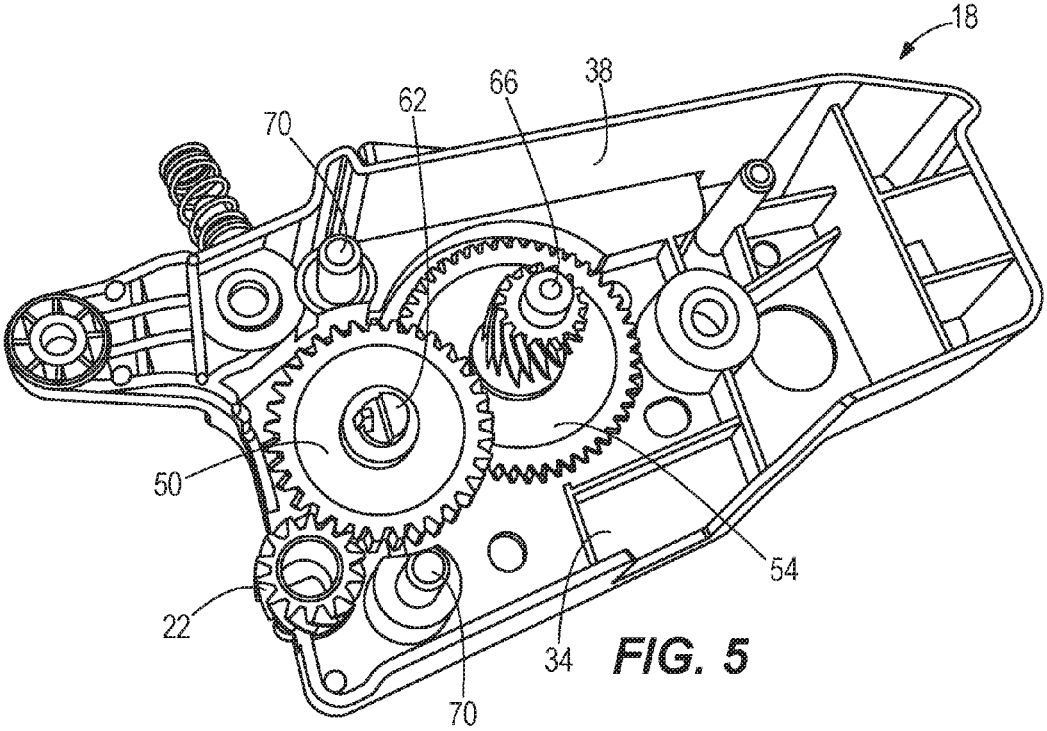
FIG. 5 is a perspective view of the interior of the end cap of FIG. 3 with an alignment bracket removed.
Figure 6:
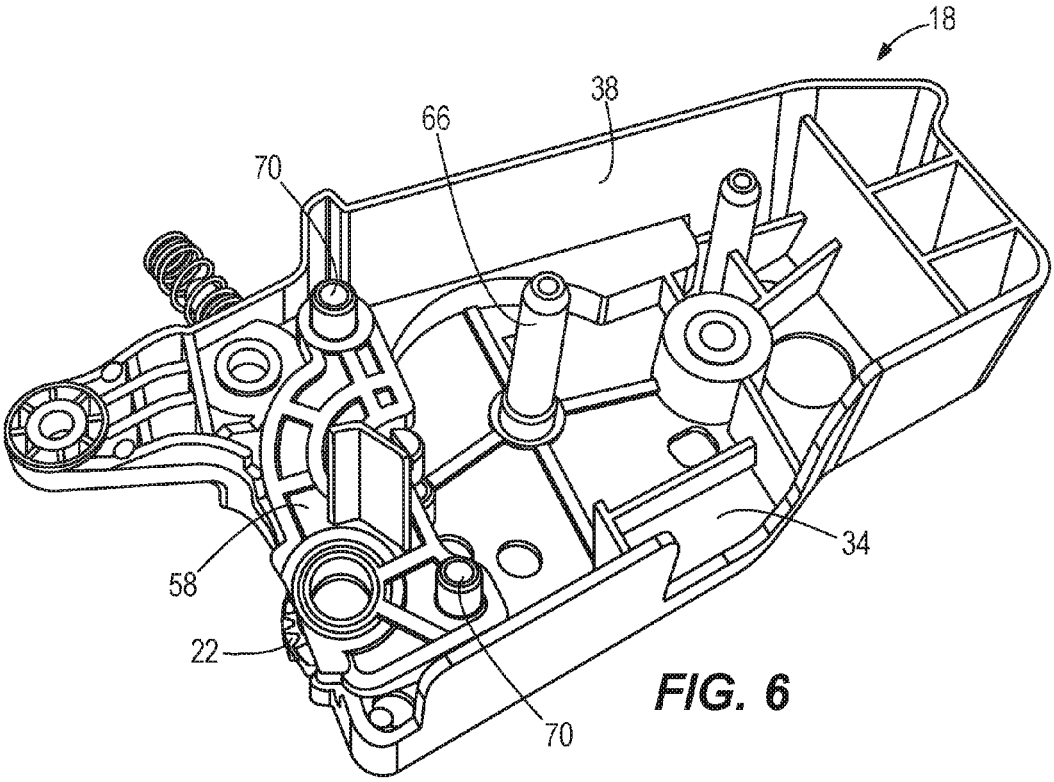
FIG. 6 is a perspective view of the interior of the end cap of FIG. 3 in a modified configuration that permits a post test of the toner cartridge without removing an internal toner seal.

Modification of the end cap 18 to prevent removal of the internal seal during a post test may include at least partially disabling the drive mechanism 46. One way of at least partially disabling the drive mechanism 46 includes removing at least one of the intermediate gear 50 and the drive gear 54. To remove one or both of these gears, the retainer 58 may be removed, as shown in FIG. 5, which allows the intermediate gear 50 to be removed from its axle 62. Once the intermediate gear 50 is removed, the drive gear 54 may also be removed from its axle 66 and the retainer 58 may be reinstalled on its mounting posts 70 (FIG. 6). By removing the intermediate gear 50 and/or the drive gear 54 from the cavity 42, the mag roller gear 22 is decoupled from the toner seal removal mechanism provided within the toner hopper 10. Thus, with the modified end cap 18 installed on the cartridge 2, when driving rotational force from the printer causes rotation of the mag roller 26 and mag roller gear 22 upon installation of the cartridge 2 into a printer, rotation of the mag roller gear 22 is not transmitted to the toner seal removal mechanism and the toner seal remains in place. In this way, by installing the modified end cap 18 onto the toner cartridge 2 during a remanufacturing operation, a post test can be performed without disturbing the toner seal.

Once the toner cartridge 2 has been remanufactured and a post test has been completed, the modified end cap 18 may be removed from the toner cartridge 2 and a non-modified end cap having a fully functional drive mechanism 46 (e.g., a drive mechanism that includes both the intermediate gear 50 and the drive gear 54) may be installed in its place. The remanufactured toner cartridge 2 with the non-modified end cap 18 may then be packaged and shipped for sale to an end user. Upon installation of the remanufactured cartridge 2 with the non-modified end cap 18 into a printer, the drive mechanism 46 will function normally to transmit driving rotational force to the toner seal removal mechanism such that the toner seal is removed and normal printing can commence.

When the modified end cap 18 is removed from the cartridge 2 after the post test, the modified end cap 18 may be returned to an earlier position on the assembly line to be used again in the manufacturing of another toner cartridge 2. In this way, a remanufacturer may harvest a plurality of end caps from used toner cartridges and modify the harvested plurality of end caps for repeated use in its remanufacturing operations. These modified end caps 18 may be specially marked or labeled to clearly distinguish the modified end caps 18 from the unmodified end caps 18.

Figure 7:
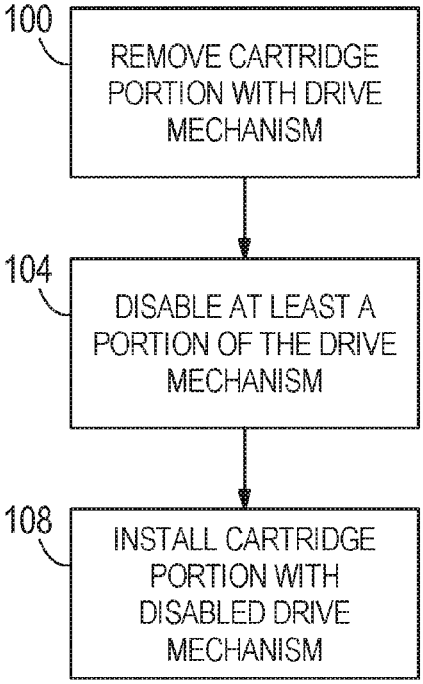
FIG. 7 is a flow chart depicting a method of modifying a toner cartridge component to permit a post test of the toner cartridge without removing an internal toner seal.

In view of the above, methods for remanufacturing toner cartridges may be provided. For example, and with reference to FIG. 7, a method of modifying a toner cartridge component to permit a post test of the toner cartridge without removing an internal toner seal may be provided. The method may include removing a portion (e.g., the end cap 18) of the toner cartridge that includes a drive mechanism 46 for driving a toner seal removal mechanism as at 100 to uncover the drive mechanism 46. The method may also include, disabling at least a portion of the drive mechanism 46 as at 104, and installing or reinstalling (as the case may be) the portion of the toner cartridge to recover the drive mechanism 46 while at least a portion of the drive mechanism is disabled as at 108. Disabling at least a portion of the drive mechanism may include removing at least one gear (e.g., intermediate gear 50 or drive gear 54) of the drive mechanism. Removing the portion of the toner cartridge that includes the drive mechanism may include removing the portion of the toner cartridge and the drive mechanism as a single piece. Reinstalling the portion of the toner cartridge may include reinstalling the portion of the toner cartridge and the drive mechanism as a single piece. The method may also include separating a hopper section 10 of the cartridge 2 from a waste section 4 of the cartridge 2, as described above, before removing the portion of the toner cartridge. The method may also further include reconnecting the hopper section 10 of the cartridge 2 to the waste section 4 of the cartridge after reinstalling the portion of the toner cartridge.

Figure 8:
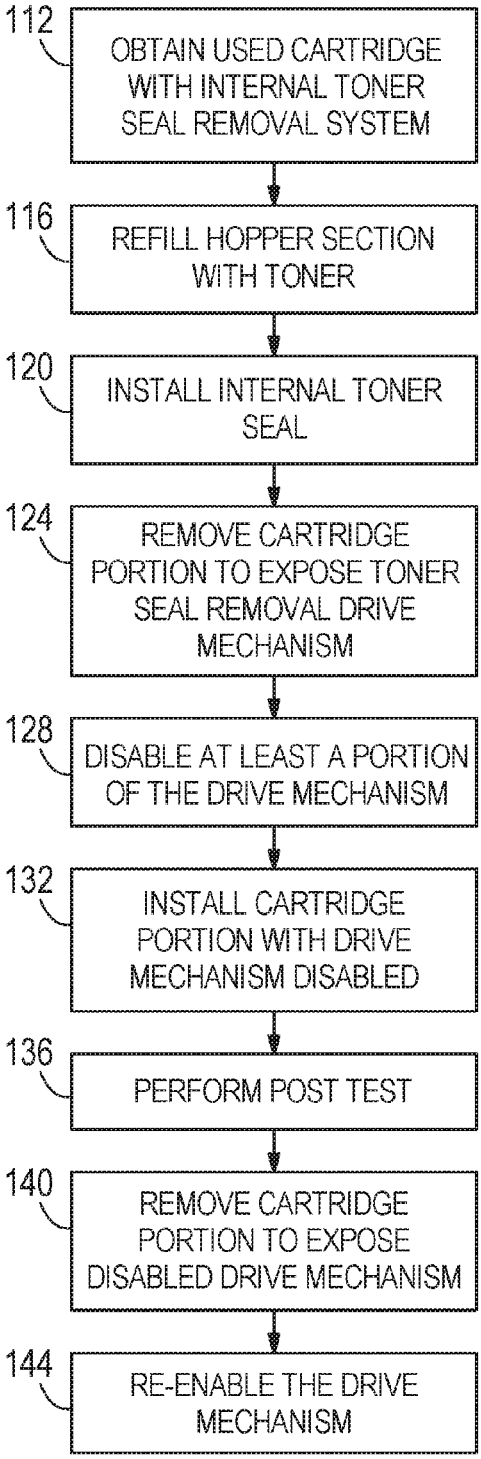
FIG. 8 is a flow chart depicting a method of remanufacturing a toner cartridge.

With reference to FIG. 8, another exemplary method of remanufacturing a toner cartridge includes obtaining a used toner cartridge configured for use with an internal toner seal that is automatically removed upon installation of the toner cartridge in a printer as at 112, refilling a hopper section of the toner cartridge with toner as at 116, and installing the internal toner seal as at 120. The method may also include removing a portion of the toner cartridge (e.g., the end cap 18) to uncover a drive mechanism 46 for operating a toner seal removal mechanism as at 124. At least a portion of the drive mechanism may then be disabled as at 128, and the portion of the toner cartridge may be reinstalled to recover the drive mechanism 46 while the drive mechanism 46 is disabled as at 132. Recovering the drive mechanism in this context may include the situation where the drive mechanism 46 is part of the end cap 18 such that installing the end cap 18 on the cartridge captures the drive mechanism between the end cap 18 and the toner hopper 10. The method may also include installing the toner cartridge with the disabled drive mechanism into a printer to perform a post test as at 136, during which time the toner seal is not removed, and removing the toner cartridge from the printer after the post test. With the post test complete, the portion of the toner cartridge (e.g., the end cap 18) may be removed to uncover the disabled drive mechanism as at 140, and the drive mechanism may be re-enabled to permit operation of the toner seal removal mechanism as at 144. In this context, re-enabling the drive mechanism may include installing an end cap 18 with a functional drive mechanism in place of the modified end cap 18 with the non-functional drive mechanism.

In this example, the drive mechanism for operating the toner seal removal mechanism may include a plurality of gears, and disabling the drive mechanism may include removing at least one gear from the drive mechanism. As noted, the drive mechanism for operating the toner seal removal mechanism may be mounted to the end cap, and disabling the drive mechanism may include removing at least one gear from the end cap.

Figure 9:
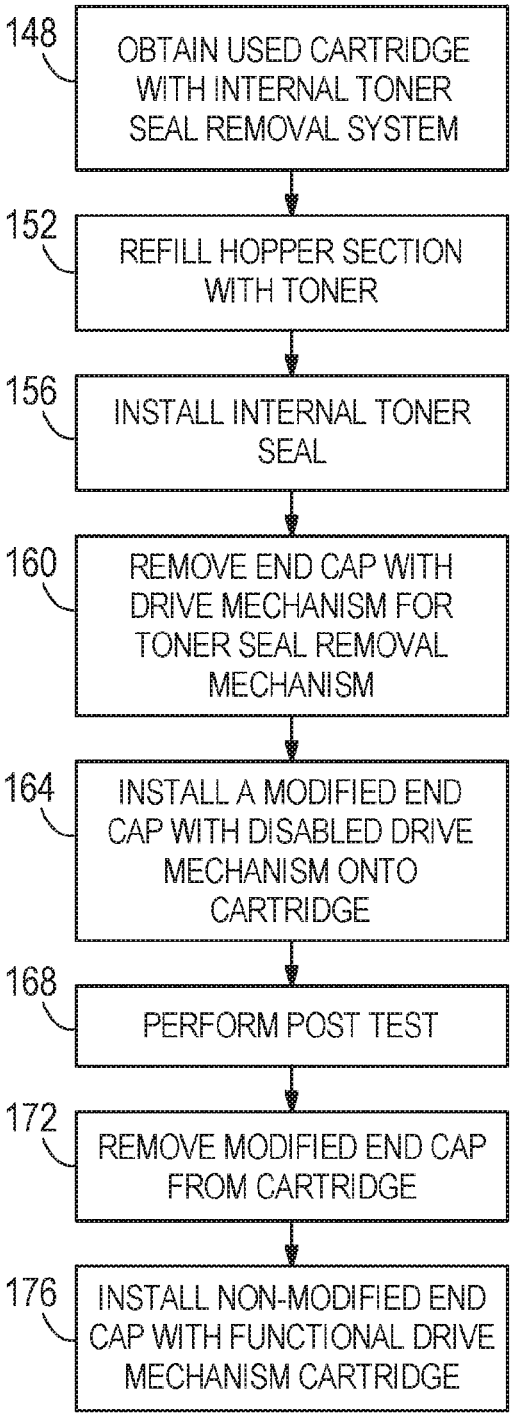
FIG. 9 is a flow chart depicting another method of remanufacturing a toner cartridge.

With reference to FIG. 9, another exemplary method of remanufacturing a toner cartridge includes obtaining a used toner cartridge configured for use with an internal toner seal that is automatically removed upon installation of the toner cartridge in a printer as at 148. A hopper section of the toner cartridge may be refilled as at 152, and the original internal toner seal or a replacement internal toner seal may be installed over a toner window inside the hopper section as at 156. An end cap 18 of the toner cartridge including a drive mechanism for operating a toner seal removal mechanism may be removed as at 160. A modified end cap with a disabled drive mechanism 46, which may be the original end cap or a different end cap, may then be created and installed onto the toner cartridge as at 164, and the toner cartridge with the modified end cap may be installed into a printer to perform a post test as at 168. Because the drive mechanism 46 is disabled, the internal toner seal will not be removed during the post test. After the post test the toner cartridge is removed from the printer and the modified end cap is removed from the cartridge as at 172. A non-modified end cap with a functional drive mechanism is then installed onto the cartridge as at 176 to permit operation of the toner seal removal mechanism upon a subsequent insertion of the toner cartridge into a printer.

Figure 10:
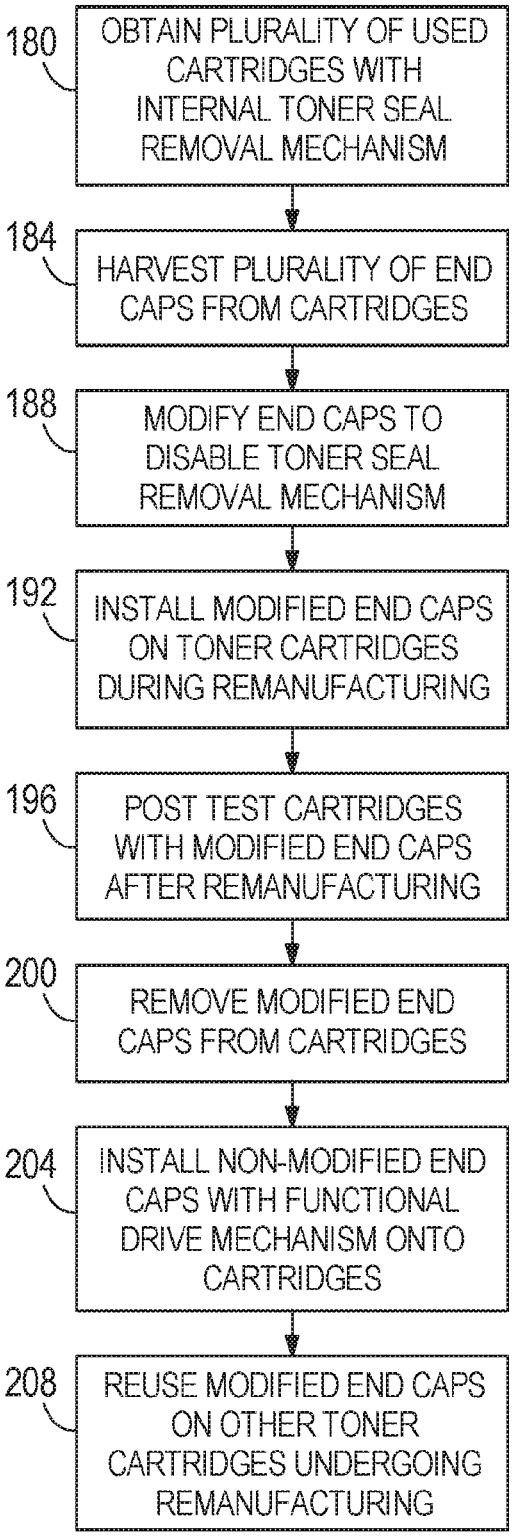
FIG. 10 is a flow chart depicting a method of remanufacturing a plurality of toner cartridges.

With reference to FIG. 10, another exemplary method includes remanufacturing a plurality of toner cartridges. This method includes obtaining a plurality of used toner cartridges as at 180, where each toner cartridge is configured for use with an internal toner seal that is automatically removed upon installation of the toner cartridge in a printer, and further where each toner cartridge includes an end cap 18 including a drive mechanism 46 for operating a toner seal removal mechanism. A plurality of end caps may be harvested from some of the used toner cartridges as at 184, and the harvested end caps may be modified to disable the drive mechanism 46 in each end cap as at 188, for example by removing at least one gear of the drive mechanism 46. The modified end caps are installed onto the toner cartridges during a remanufacturing process as at 192. More specifically, one modified end cap is installed on each toner cartridge that goes through the remanufacturing process. The toner cartridges including the modified end caps that have gone through the remanufacturing process are then post tested as at 196. The modified end caps are removed from the post tested toner cartridges as at 200, and non-modified end caps with functional drive mechanisms are installed onto the post tested toner cartridges as at 204. The modified end caps may then be reused on other toner cartridges that are undergoing the remanufacturing process as at 208.

It should be appreciated that the exemplary description provided above refers to one specific style of toner cartridge, but that the teachings and concepts set forth may be applied to a variety of toner cartridges having different forms of construction. For example, other toner cartridges may have a different arrangement of end caps, gears, and the like such that more or fewer components are modified or removed to prevent the toner seal from being removed during a post test.

In addition, the method steps described above are not necessarily required to be performed in the order in which they are described, and not all method steps will be necessary for all types of toner cartridges.

Accordingly, the scope of the invention shall be defined by the following claims and the foregoing exemplary descriptions should not be regarded as limiting.

What is claimed is:

1. A method of remanufacturing a toner cartridge, the method comprising:

obtaining a used toner cartridge configured for use with an internal toner seal that is automatically removed upon installation of the toner cartridge in a printer;

refilling a hopper section of the toner cartridge and installing the internal toner seal;

removing an end cap of the toner cartridge, the end cap including a drive mechanism for operating a toner seal removal mechanism;

creating a modified end cap to disable the drive mechanism;

installing the modified end cap onto the toner cartridge;

installing the toner cartridge with the modified end cap into a printer to perform a post test;

removing the toner cartridge from the printer after the post test;

removing the modified end cap; and installing a non-modified end cap with a functional drive mechanism to permit operation of the toner seal removal mechanism upon a subsequent insertion of the toner cartridge into a printer.

2. The method of claim 1, wherein creating the modified end cap includes removing at least one gear.

3. The method of claim 1, wherein installing the non-modified end cap includes reinstalling the end cap that was previously removed.

4. A method of remanufacturing a plurality of toner cartridges, the method comprising:

obtaining a plurality of used toner cartridges, each toner cartridge configured for use with an internal toner seal that is automatically removed upon installation of the toner cartridge in a printer, and each toner cartridge including an end cap including a drive mechanism for operating a toner seal removal mechanism;

harvesting a plurality of the end caps from some of the plurality of used toner cartridges;

modifying the harvested plurality of end caps to disable the drive mechanism in each end cap;

installing one of the modified plurality of end caps on each of the plurality of used toner cartridges during a remanufacturing process;

post testing the toner cartridges that have received one of the modified plurality of end caps;

removing the modified end cap from each post tested toner cartridge; and installing a non-modified end cap with a functional drive mechanism on each post tested toner cartridge.

5. The method of claim 4, wherein modifying the harvested plurality of end caps includes removing at least one gear from the drive mechanism in each end cap.

6. The method of claim 4, further comprising reusing the removed modified end caps.

* * * * *